US011585523B2

(12) United States Patent
Liu et al.

(10) Patent No.: US 11,585,523 B2
(45) Date of Patent: Feb. 21, 2023

(54) LIGHTING FIXTURE AND BREATHING STRUCTURE FOR LIGHTING FIXTURE

(71) Applicant: OPPLE LIGHTING CO., LTD., Shanghai (CN)

(72) Inventors: Zhanguo Liu, Shanghai (CN); Zhukun Wang, Shanghai (CN)

(73) Assignee: Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/337,242

(22) Filed: Jun. 2, 2021

(65) Prior Publication Data

US 2021/0285630 A1 Sep. 16, 2021

Related U.S. Application Data

(63) Continuation of application No. PCT/CN2019/123720, filed on Dec. 6, 2019.

(30) Foreign Application Priority Data

Dec. 7, 2018 (CN) ..... 201822052994.8

(51) Int. Cl.
*F21V 31/03* (2006.01)
*F21V 17/06* (2006.01)

(52) U.S. Cl.
CPC ..... *F21V 31/03* (2013.01); *F21V 17/06* (2013.01)

(58) Field of Classification Search
CPC ..... F21V 31/03; F21V 17/06
See application file for complete search history.

(56) References Cited

U.S. PATENT DOCUMENTS 6,174,077 B1 * 1/2001 Bucher ..... F21V 33/0096 362/438
9,574,760 B1 * 2/2017 Olsson ..... H05B 45/3725
(Continued)

FOREIGN PATENT DOCUMENTS

CN 201487904 U 5/2010
CN 202253518 * 5/2012 ..... G02F 1/133615
(Continued)

OTHER PUBLICATIONS

International Search Report of PCT Application No. PCT/CN2019/123720 dated Mar. 11, 2020 with English translation, (4p).

*Primary Examiner* — Fatima N Farokhrooz
(74) *Attorney, Agent, or Firm* — Arch & Lake LLP

(57) ABSTRACT

The present disclosure provides a breathing structure for a lighting fixture, and a lighting fixture comprising the breathing structure. The lighting fixture includes a lamp body which has an inner cavity. The breathing structure includes: a mounting portion, arranged on the lamp body and protruded from the lamp body; a through hole, formed in the mounting portion, the through hole penetrating the mounting portion and being communicated with the inner cavity of the lamp body; a breathable film, arranged on one end of the through hole facing towards an outside of the lamp body; a washer, arranged on the breathable film and provided with a vent slot; and an elastic fastener, fastened on the mounting portion and configured to compress the washer towards a direction of the inner cavity of the lamp body.

20 Claims, 4 Drawing Sheets

(56) References Cited

U.S. PATENT DOCUMENTS

| | | | | |
|---|---|---|---|---|
| 2005/0111227 | A1* | 5/2005 | Leddusire | F21V 17/02 362/351 |
| 2011/0027516 | A1 | 2/2011 | Ni et al. | |
| 2012/0207970 | A1* | 8/2012 | Kamikawa | B32B 3/263 428/137 |
| 2016/0209022 | A1 | 7/2016 | Cai et al. | |
| 2018/0094802 | A1 | 4/2018 | Cai et al. | |

FOREIGN PATENT DOCUMENTS

| | | | | |
|---|---|---|---|---|
| CN | 103958964 | * | 7/2014 | F21S 45/30 |
| CN | 104676560 | A | 6/2015 | |
| CN | 204554399 | U * | 8/2015 | F21S 45/30 |
| CN | 207486767 | U | 6/2018 | |
| CN | 209431372 | U | 9/2019 | |
| JP | 2011181220 | A * | 9/2011 | |
| WO | 2015031810 | A1 | 3/2015 | |

* cited by examiner

LIGHTING FIXTURE AND BREATHING STRUCTURE FOR LIGHTING FIXTURE

CROSS-REFERENCE TO RELATED APPLICATIONS

This application is based upon and claims the priority of PCT patent application No. PCT/CN2019/123720 filed on Dec. 6, 2019 which claims priority to the Chinese patent application No. 201822052994.8 filed on Dec. 7, 2018, the entire content of both of which is hereby incorporated by reference herein for all purposes.

TECHNICAL FIELD

The present disclosure relates to the technical field of lighting, in particular to a breathing structure for a lighting fixture, and a lighting fixture comprising the breathing structure.

BACKGROUND

Some lighting fixtures, especially outdoor lighting fixtures, need to be sealed in order to reach a certain protection level. After these lighting fixtures are turned on, due to concentrated heating of light sources, an internal temperature of each lamp body gradually rises to form a closed high-temperature space; air in the lamp body expands in the high-temperature space to generate a pressure difference with outside air, so that the air may leak from a sealed gap of each lighting fixture to the outside air. Even worse, if the air cannot be discharged, deformation or burst damage of the lighting fixture may be caused. When the lighting fixtures are turned off, the internal temperature of each lamp body drops, so air shrinks to form a low pressure lower than the outside atmospheric pressure. At this time, outside air and water vapor may enter the lamp body to achieve a pressure balance between inside and outside the lamp body. During air intake of the lighting fixtures, water vapor entering each lamp body may condense into water, resulting in reduction of performances of the lighting fixtures to affect lighting effects.

SUMMARY

The present disclosure provides a breathing structure for a lighting fixture, a lighting fixture and a method of manufacturing a lighting fixture.

According to a first aspect of the present disclosure, it is provided a breathing structure for a lighting fixture that may include a lamp body which has an inner cavity. The breathing structure may include a mounting portion, arranged on the lamp body and protruded from the lamp body; a through hole, formed in the mounting portion, the through hole penetrating the mounting portion and being communicated with the inner cavity of the lamp body; a breathable film, arranged on one end of the through hole facing towards an outside of the lamp body; a washer, arranged on the breathable film and provided with a vent slot; and an elastic fastener, fastened on the mounting portion and configured to compress the washer towards a direction of the inner cavity of the lamp body.

According to a second aspect of the present disclosure, a lighting fixture is provided. The lighting fixture may include a lamp body comprising an inner cavity; a light emitting component, arranged in the inner cavity; and a breathing structure for the lighting fixture. The breathing structure may include a mounting portion, arranged on the lamp body and protruded from the lamp body; a through hole, formed in the mounting portion, the through hole penetrating the mounting portion and being communicated with the inner cavity of the lamp body; a breathable film, arranged on one end of the through hole facing towards an outside of the lamp body; a washer, arranged on the breathable film and provided with a vent slot; and an elastic fastener, fastened on the mounting portion and configured to compress the washer towards a direction of the inner cavity of the lamp body.

According to a further aspect of the present disclosure, a method of manufacturing a lighting fixture is provided. The method may include providing a lamp body comprising an inner cavity; arranging a light emitting component in the inner cavity; providing a breathing structure for the lighting fixture; arranging a mounting portion on the lamp body that is protruded from the lamp body; forming a through hole in the mounting portion where the through hole penetrates the mounting portion and is communicated with the inner cavity of the lamp body; arranging a breathable film on one end of the through hole facing towards an outside of the lamp body; arranging a washer on the breathable film that is provided with a vent slot; and fastening an elastic fastener on the mounting portion that is configured to compress the washer towards a direction of the inner cavity of the lamp body.

It is to be understood that both the foregoing general description and the following detailed description are exemplary and explanatory only and are not restrictive of the present disclosure.

BRIEF DESCRIPTION OF THE DRAWINGS

Those ordinarily skill in the art will clearly understand various other advantages and benefits, through reading the detailed description of preferred implementation modes hereinafter. The accompanying drawings are provided only for illustrating the preferred implementation modes, rather than limiting the present disclosure. Throughout the accompanying drawings, same reference signs usually denote same components. In the drawings.

DETAILED DESCRIPTION

Figure 1:
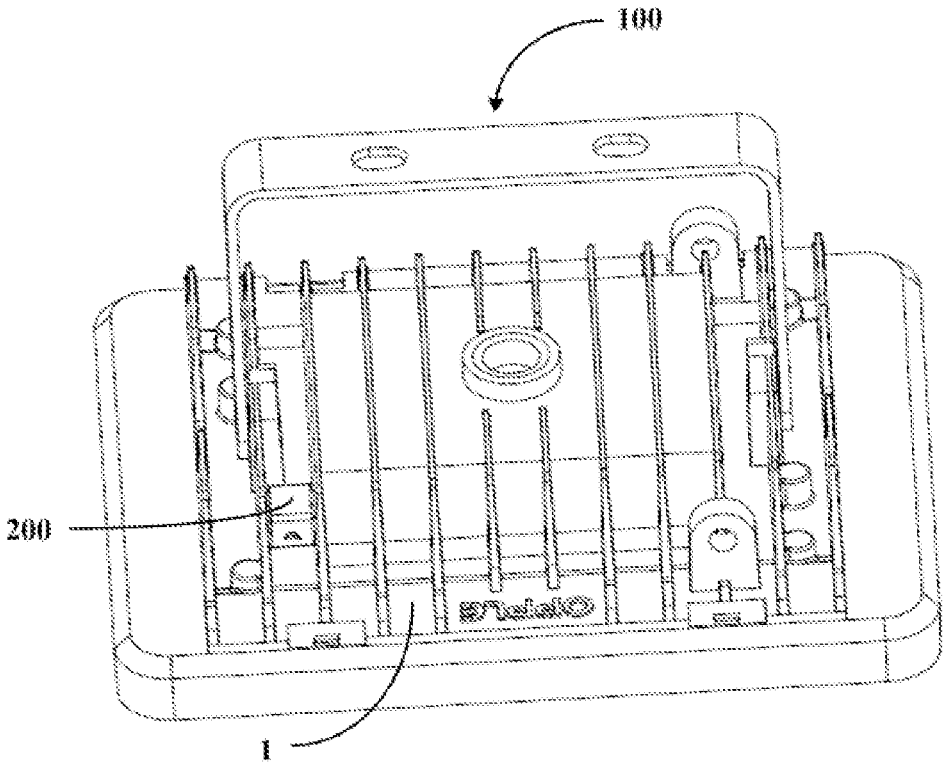
FIG. 1 illustrates a schematically structural diagram of a lighting fixture according to an example of the present disclosure.

Hereinafter, examples of the present disclosure will be described in more detail with reference to the accompanying drawings. Although the examples of the present disclosure are illustrated in the drawings, it should be understood that the present disclosure may be implemented in various forms and should not be limited by the examples explained here. On the contrary, these examples are provided so that the present disclosure may be understood more thoroughly, and the scope of the present disclosure may be completely conveyed to those skilled in the art.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

An outdoor lighting fixture sometimes needs to be sealed in order to reach a required protection level, and a sealed lighting fixture structure may inevitably face damage or hidden dangers caused by breathing of the lighting fixture.

In order to eliminate the above-mentioned influence caused by the breathing of the lighting fixture, two treatment methods are mainly provided. The first is to arrange a breather having a specific requirement outside the lighting fixture; however, a threaded through hole cooperated with an inner cavity of the lighting fixture and a corresponding sealing structure are generally needed for mounting of the breather, which is complicated in design. The second is to provide a breathing structure inside the lighting fixture. Although this method can protect the breathing structure, delay aging, and prolong its life, because the entire breathing structure is arranged inside the lighting fixture, the inner cavity of the lighting fixture needs to be opened during mounting and replacing, which is quite inconvenient.

In order to solve the above problems, examples of the present disclosure provide a breathing structure for a lighting fixture, and a lighting fixture comprising the breathing structure.

FIG. 1 illustrates a schematically structural diagram of a lighting fixture 100 according to an example of the present disclosure. Referring to FIG. 1, the lighting fixture 100 includes a lamp body 1 with an inner cavity 11 (refer to FIG. 4 and FIG. 5), a light emitting component (not shown in the figure) arranged in the inner cavity 11, and a breathing structure 200 arranged on the lamp body 1 and used for the lighting fixture. The breathing structure 200 is communicated with the inner cavity 11 and used for achieving a pressure balance between inside and outside the lighting fixture during on and off of the lighting fixture as well as achieving waterproofness. It is to be noted that the breathing structure 200 as shown in FIG. 1 arranged on a rear side of the lamp body of the lighting fixture 100 is only an illustrative arrangement manner. In actual applications, the breathing structure 200 may be arranged at any position of the lamp body 1 that is communicated with the inner cavity 11 of the lamp body according to actual requirements. In addition, a contour of the lamp body of the lighting fixture shown in FIG. 1 is also only for illustrative purpose. In practical applications, the breathing structure 200 may be applied to the sealed lighting fixture having any contours, especially outdoor lighting fixtures.

FIG. 2 to FIG. 6 further illustrate structural details of the breathing structure 200 for the lighting fixture according to the examples of the present disclosure. Referring to FIG. 2 to FIG. 6, the breathing structure 200 includes a mounting portion 2, a through hole 21, a breathable film 3, a washer 4, and an elastic fastener 5.

The following specifically describes various elements, as well as connection relationships between the elements, of the breathing structure 200 for the lighting fixture, provided by the examples of the present disclosure.

Figure 2:
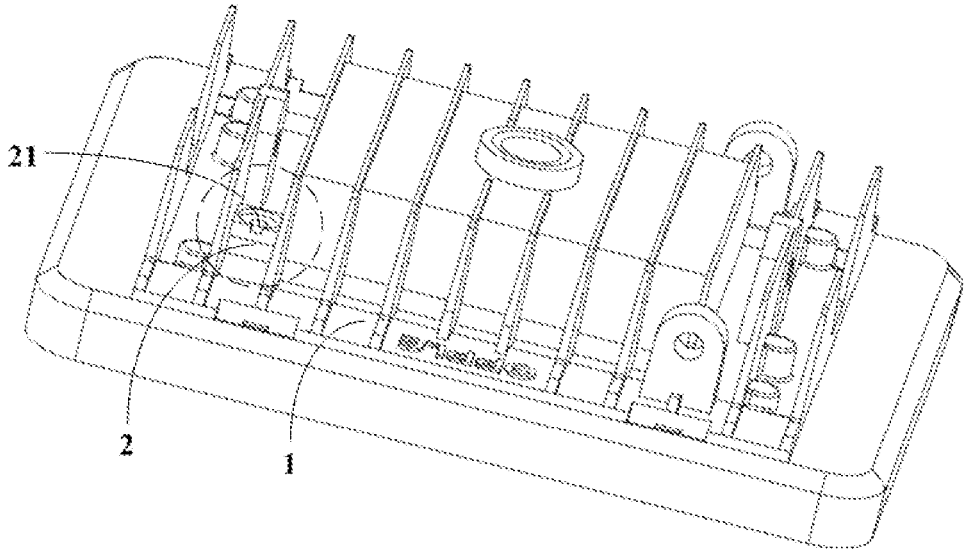
FIG. 2 illustrates a schematic diagram of a mounting portion of a breathing structure for a lighting fixture according to an example of the present disclosure.

FIG. 2 illustrates a schematic diagram of a mounting portion 2 of a breathing structure 200 for a lighting fixture according to an example of the present disclosure. A part enclosed by a dotted line in FIG. 2 is the mounting portion 2 of the breathing structure 200. Referring to FIG. 2, the mounting portion 2 refers to a structure that is integrally arranged on the lamp body 1 and protruded from the lamp body 1. A through hole 21 is formed in the mounting portion 2. The through hole 21 penetrates the mounting portion 2, and is communicated with the inner cavity 11 (refer to FIG. 4 and FIG. 5) of the lamp body 1 to facilitate breathing of the lighting fixture. It is to be noted that the shape and position of the mounting portion 2 shown in the figure is only for illustrative purpose. In actual applications, the outer contour shape of the cross section of the mounting portion 2 may be circular, rectangular, or polygonal. In addition, on the premise of not affecting normal functions of the lighting fixture, the mounting portion 2 may be arranged at any positions of the lamp body 1 that may be communicated with the inner cavity 11 of the lamp body. Moreover, in the example, although the mounting portion 2 is protruded along a direction perpendicular to a rear surface of the lamp body 1, the present disclosure is not limited to this. As long as the through hole 21 running through the mounting portion 2 can be communicated with the inner cavity 11 of the lamp body, the mounting portion 2 may be protruded from the lamp body 1 along any directions, for example, along a direction parallel to the rear surface of the lamp body 1.

Figure 3:
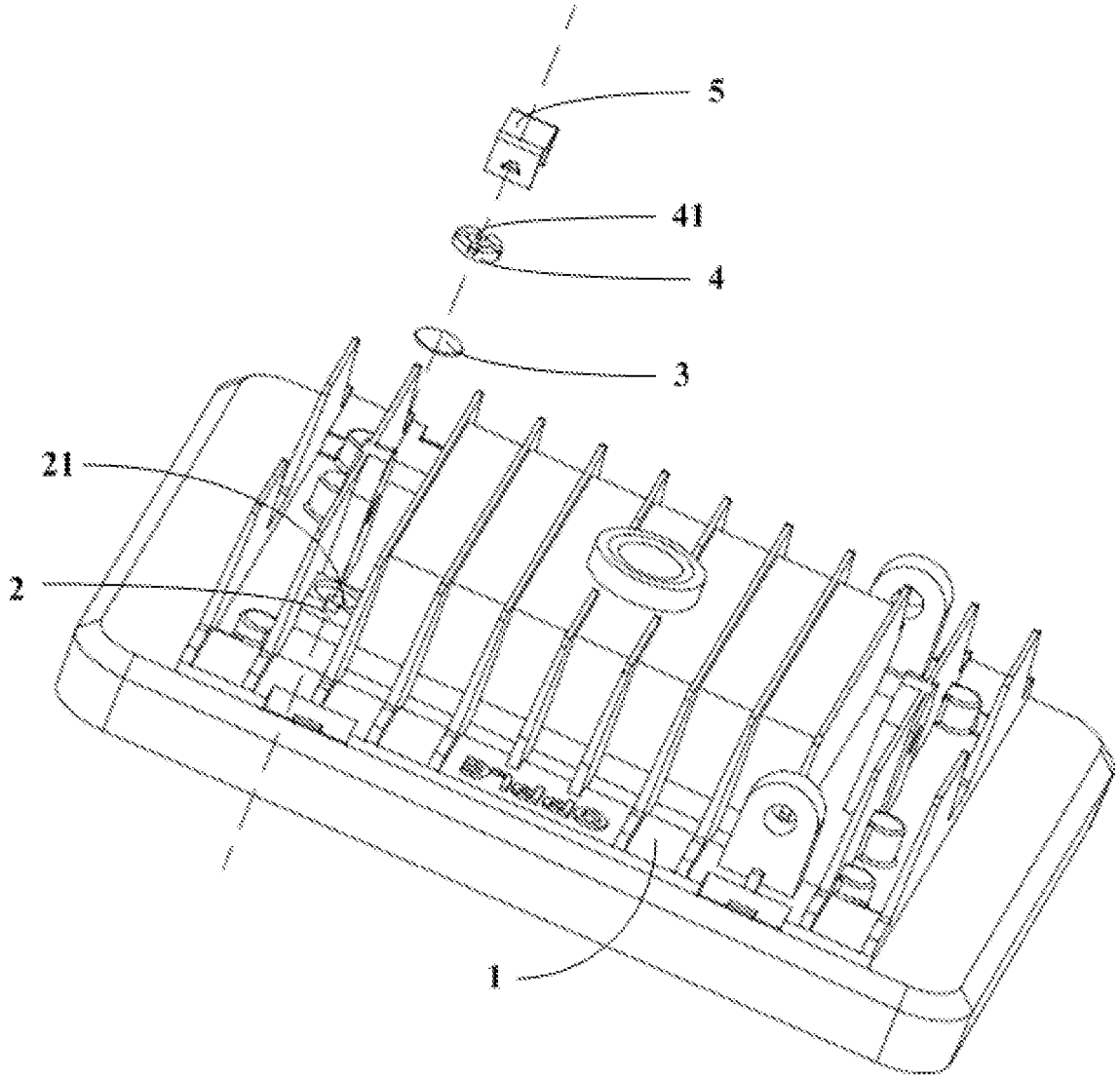
FIG. 3 illustrates an exploded view of a breathing structure for a lighting fixture according to an example of the present disclosure.
Figure 4:
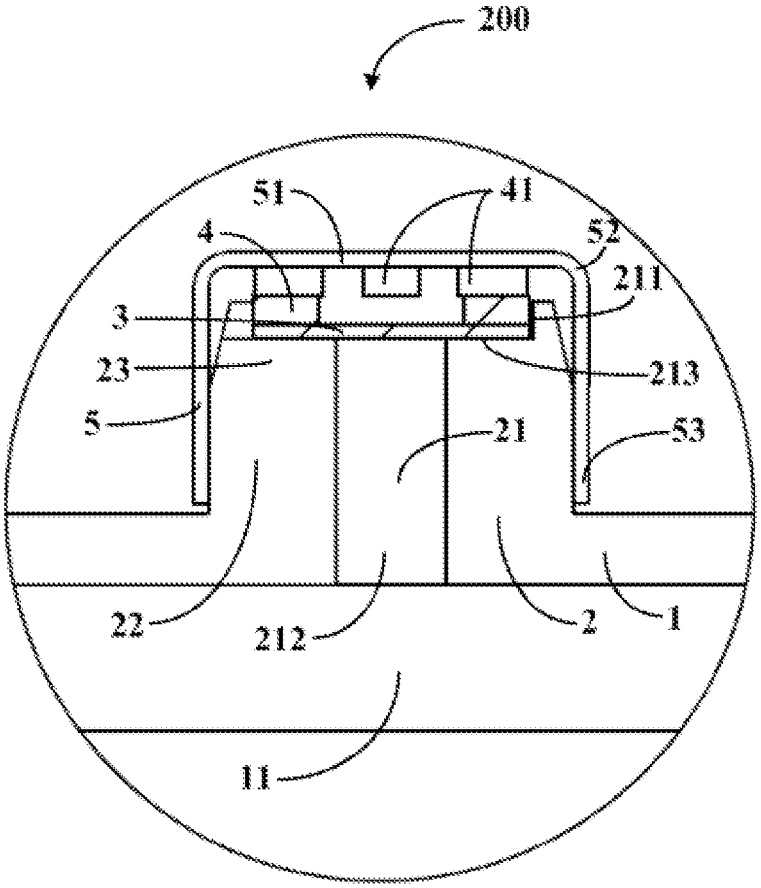
FIG. 4 illustrates a sectional view, along a central axis, of an assembled breathing structure for a lighting fixture, according to an example of the present disclosure.

FIG. 3 is an exploded view of a breathing structure 200 for a lighting fixture according to an example of the present disclosure. As shown in FIG. 3, the breathable film 3, the washer 4, and the elastic fastener 5 are sequentially assembled to the mounting portion 2 by taking a dotted line shown in FIG. 3 as the axis. FIG. 4 is a sectional view, along a central axis, of an assembled breathing structure 200 for a lighting fixture, according to an example of the present disclosure. Referring to FIG. 3 and FIG. 4, the breathable film 3 is arranged at one end of the through hole 21 facing towards the outside of the lamp body 1. The washer 4 is arranged on the breathable film 3 and provided with a vent slot 41. Breathability of the entire breathing structure is ensured by means of the breathable film 3 and the vent slot 4. The elastic fastener 5 is fastened onto a peripheral wall of the mounting portion 2 and used to compress the washer 4 towards a direction of the inner cavity 11 of the lamp body 1 so as to allow the breathable film 3 to be tightly attached to one end face of the through hole 21.

The breathable film 3 may be a waterproof and breathable film, such as an elastic silica gel membrane, or a polytetrafluoroethylene membrane. The washer 4 may be made of an elastic material, such as rubber or plastic, and preferably is a rubber pad. Moreover, the washer 4 has a certain hardness, preferably a hardness of 70, so that when the washer 4 is compressed by the elastic fastener 5, a certain amount of compression can be ensured, while avoiding failure of a venting function of the vent slot 41 caused by excessive deformation. Because the breathable film has waterproof and breathable performances, the problem of a pressure difference between the inside and outside of the lighting fixture during on and off of the lighting fixture can be effectively solved by using the breathable film, thereby effectively improving waterproofness of the outdoor lighting fixture. With the press-fit design of the washer, the problem of poor reliability of a breathable film product when mounted separately can be solved, so that falling off of the breathable film can be effectively prevented. Moreover, with the design of the elastic fastener, the whole mounting process of the breathing structure is simplified, the washer can keep a certain amount of compression at all times, so as to ensure an attaching degree of the breathable film.

In an example, as shown in FIG. 3 and FIG. 4, the vent slot 41 is a cross-shaped slot. The washer is provided with the vent slot shaped as a cross-shaped slot to ensure that the entire breathing structure can fully breathe through the cross-shaped slot, thereby achieving a better breathing effect.

In an example, continuing to refer to FIG. 3 and FIG. 4, the elastic fastener 5 is a U-shaped elastic fastener. With the design of the U-shaped elastic fastener, mounting of the entire breathing structure can be completed simply and reliably.

Figure 6:
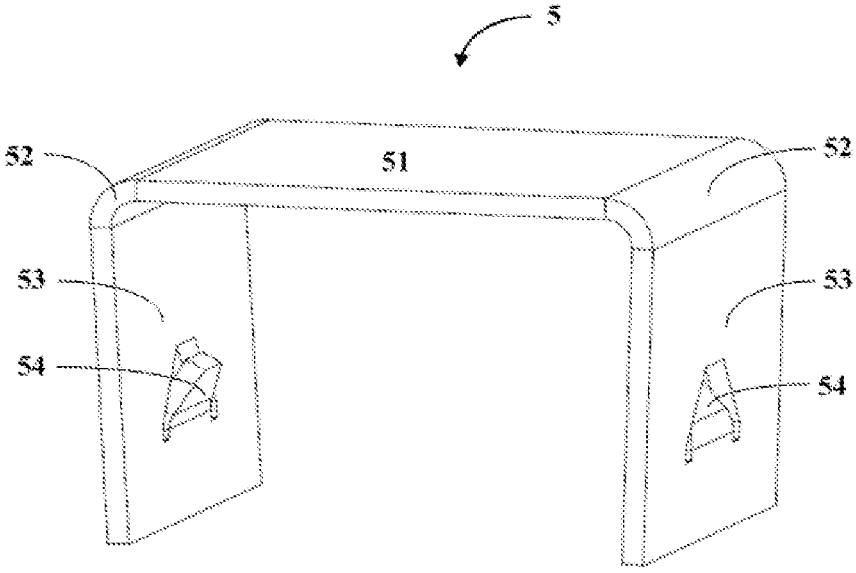
FIG. 6 illustrates a schematically structural diagram of a U-shaped elastic fastener of a breathing structure for a lighting fixture according to an example of the present disclosure.

FIG. 6 illustrates a schematically structural diagram of a U-shaped elastic fastener 5 of a breathing structure 200 for a lighting fixture according to an example of the present disclosure. Further, as shown in FIG. 4 and FIG. 6, the U-shaped elastic fastener 5 includes a pressing portion 51 in a planar shape, two bending portions 52 respectively connected to two ends of the pressing portion 51, and two retaining portions 53 which are opposite to each other and respectively connected to the two bending portions 52. When the elastic fastener 5 is fastened on the mounting portion 2, the retaining portions 53 are directly abutted against the peripheral wall of the mounting portion 2 to be in interference fit with the peripheral wall of the mounting portion 2, so that the pressing portion 51 is in close contact with a top surface of the washer 4.

More preferably, the peripheral wall of the mounting portion 2 includes two planar-shaped lateral surfaces that are opposite and parallel to each other; and when the elastic fastener 5 is fastened on the mounting portion 2, the retaining portions 53 are respectively abutted against the two lateral surfaces of the mounting portion 2 which are parallel and opposite to each other, so as to be in interference fit with the two lateral surfaces, thereby improving reliability in mounting of the entire structure.

Figure 5:
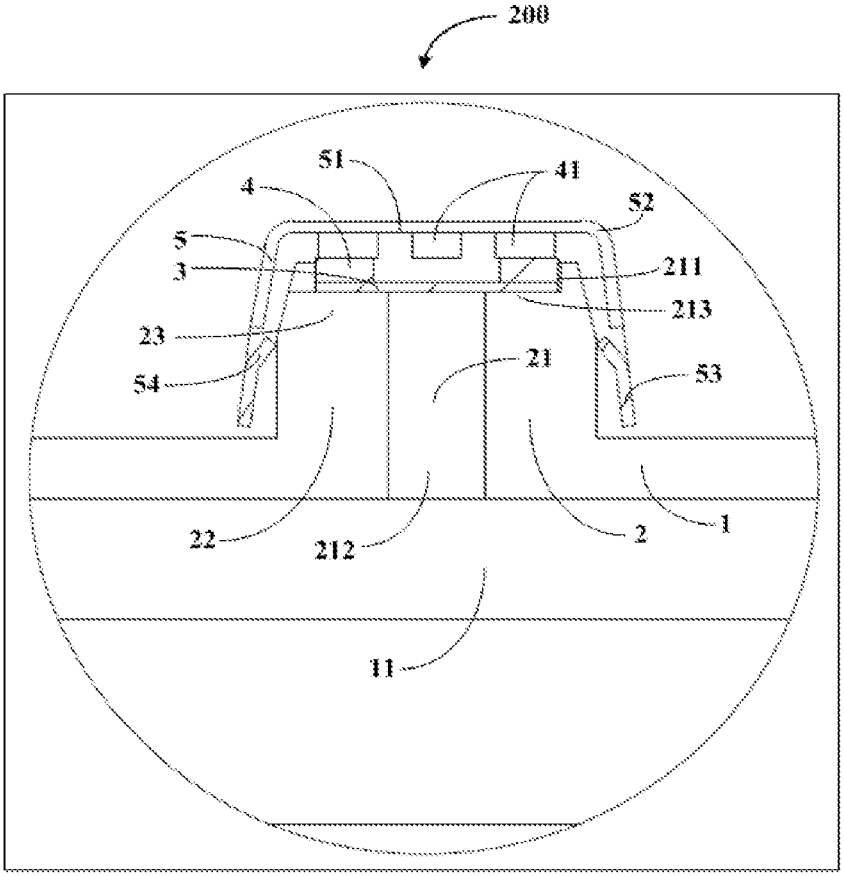
FIG. 5 illustrates a sectional view, along a central axis, of an assembled breathing structure for a lighting fixture, according to another example of the present disclosure.

Furthermore preferably, at least one of the two retaining portions 53 is provided with a barb-shaped clip 54. FIG. 5 illustrates a sectional view, along a central axis, of an assembled breathing structure for a lighting fixture, according to another example of the present disclosure. As shown in FIG. 5 and FIG. 6, the barb-shaped clip 54 obliquely extends from an inner side of the retaining portion 53 to the pressing portion 51. With this shape design, the U-shaped elastic fastener 5 is compressed from a top surface of the mounting portion 2 to a bottom surface thereof when the elastic fastener 5 is fastened on the mounting portion 2, and the barb-shaped clip 54 is elastically deformed towards the outer side of the retaining portion 53 under action of a thrust, so as to be abutted against the peripheral wall of the mounting portion 2.

Optionally, the barb-shaped clip 54 is integrally molded with the retaining portion 53, so that the strength of the entire structure is improved. For example, the barb-shaped clip 54 and the retaining portion 53 can be integrally molded by stamping, casting, or the like.

The barb-shaped clips arranged on the elastic fastener may provide a stronger locking capacity to the elastic fastener, thereby further improving reliability of the entire breathing structure.

In an alternative example, continuing to refer to FIG. 4 and FIG. 5, the through hole 21 may be a counter bore. The counter bore 21 may include a first end 211 facing towards the outside of the lamp body 1 and a second end 212 opposite to the first end 211, and a bore diameter of the first end 211 is greater than a bore diameter of the second end 212. The breathable film 3 is arranged on a bottom surface 213, of the first end 211 with a larger bore diameter, of the counter bore 21, and the washer 4 is arranged on the breathable film 3. Preferably, sizes of the breathable film 3 and the washer 4 are adaptive to the bore diameter the first end 211 of the counter bore 21, which is conductive to the improvement the stability and reliability of the entire breathing structure. Moreover, at least part of the vent slot 41 of the washer 4 is exposed to the top surface of the mounting portion 2, thereby ensuring that the entire breathing structure can achieve ventilation through the vent slot 41.

Preferably, a bottom surface of the vent slot 41 is not lower than the top surface of the mounting portion 2. More preferably, the bottom surface of the vent slot 41 is flush with the top surface of the mounting portion 2, so that a thickness of the washer is reduced and material cost is lowered while breathability of the entire breathing structure is ensured to the utmost extent.

In an alternative example, continuing to refer to FIG. 4 and FIG. 5, the mounting portion 2 includes a cylindrical base 22 close to the inner cavity 11 of the lamp body 1, and a frustoconic portion 23 that is gradually reduced from one end close to the inner cavity 11 of the lamp body 1 to the other end facing towards the outside of the lamp body 1. The structural design of the mounting portion 2 is further conductive to mounting of the elastic fastener 5, which can prevent scrape abrasion between the elastic fastener 5 and the mounting portion 2.

According to any one of the above-mentioned examples or a combination of the above-mentioned multiple examples, the examples of the present disclosure can achieve the following beneficial effects.

The breathing structure for a lighting fixture provided by the examples of the present disclosure includes the mounting portion that is protruded from the lamp body of the lighting fixture and provided with the through hole communicated with the inner cavity of the lamp body, and the breathable film, the washer, and the elastic fastener that are sequentially assembled on one end of the through hole facing towards the outside of the lamp body, herein the elastic fastener is fastened on the mounting portion to compress the washer as well as the breathable film. Because the size of the mounting portion is small and the position of the mounting portion is more flexible, on the premise of not affecting normal functions of the lighting fixture, the mounting portion can be arranged at any position of the lamp body that is communicated with the inner cavity of the lamp body. Thus, the mounting portion is easy to design. Because the breathable film has waterproof and breathable performances, the problem of a pressure difference between the inside and outside of the lighting fixture during on and off of the lighting fixture can be effectively solved through the breathable film, thereby effectively improving waterproofness of the outdoor lighting fixture. With the press-fit design of the washer, the problem of poor reliability of a breathable film product when mounted separately can be solved, so that falling off of the breathable film can be effectively prevented. Moreover, with the design of the elastic fastener, the whole mounting process of the breathing structure is simplified, and the washer can keep a certain amount of compression at all times, so as to ensure the attaching degree of the breathable film.

Further, the washer is provided with the vent slot embodied as the cross-shaped slot to ensure that the entire breathing structure can fully breathe through the cross-shaped slot, thereby achieving better breathing effect. Furthermore, the barb-shaped clips arranged on the elastic fastener provides a stronger locking capacity to the elastic fastener, thereby further improving reliability of the entire breathing structure.

According to one aspect of the present disclosure, it is provided a breathing structure for a lighting fixture, the lighting fixture comprising a lamp body which has an inner cavity, and the breathing structure comprises:

a mounting portion, arranged on the lamp body and protruded from the lamp body;

a through hole, formed in the mounting portion, the through hole penetrating the mounting portion and being communicated with the inner cavity of the lamp body;

a breathable film, arranged on one end of the through hole facing towards an outside of the lamp body;

a washer, arranged on the breathable film and provided with a vent slot; and an elastic fastener, fastened on the mounting portion and configured to compress the washer towards a direction of the inner cavity of the lamp body.

Optionally, the vent slot is a cross-shaped slot.

Optionally, the elastic fastener is a U-shaped elastic fastener.

Optionally, the elastic fastener comprises a pressing portion in a planar shape, two bending portions respectively connected to two ends of the pressing portion, and two retaining portions which are opposite to each other and respectively connected to the two bending portions;

wherein in condition that the elastic fastener is fastened on the mounting portion, the retaining portions are abutted against a peripheral wall of the mounting portion, so that the pressing portion is in close contact with a top surface of the washer.

Optionally, the peripheral wall of the mounting portion comprises two planar-shaped lateral surfaces that are opposite and parallel to each other; and in condition that the elastic fastener is fastened on the mounting portion, the retaining portions are respectively abutted against the two planar-shaped lateral surfaces of the mounting portion.

Optionally, at least one of the two retaining portions is provided with a barb-shaped clip;

wherein the barb-shaped clip obliquely extends from an inner side of the retaining portion to the pressing portion and is configured to be abutted against the peripheral wall of the mounting portion in condition that the elastic fastener is fastened on the mounting portion.

Optionally, the barb-shaped clip and the retaining portion are integrally molded.

Optionally, the through hole is a counter bore, a bore diameter of one end, facing towards the outside of the lamp body, of the counter bore is greater than a bore diameter of the other end of the counter bore;

the breathable film is arranged on a bottom surface, of the one end with a larger bore diameter, of the counter bore; and at least part of the vent slot is exposed to a top surface of the mounting portion.

Optionally, a bottom surface of the vent slot is not lower than the top surface of the mounting portion.

Optionally, the mounting portion comprises a cylindrical base close to the inner cavity of the lamp body, and a frustoconic portion that is gradually reduced from one end close to the inner cavity of the lamp body to the other end facing towards the outside of the lamp body.

According to another aspect of the present disclosure, it is provided a lighting fixture, comprising:

a lamp body, having an inner cavity;

a light emitting component, arranged in the inner cavity; and the breathing structure for the lighting fixture according to any one of the above-mentioned examples.

The breathing structure for a lighting fixture provided by the examples of the present disclosure includes the mounting portion that is protruded from the lamp body of the lighting fixture and provided with the through hole communicated with the inner cavity of the lamp body, and the breathable film, the washer, and the elastic fastener that are sequentially assembled on one end of the through hole facing towards the outside of the lamp body, herein the elastic fastener is fastened on the mounting portion to compress the washer as well as the breathable film. Because the size of the mounting portion is small and the position of the mounting portion is more flexible, on the premise of not affecting normal functions of the lighting fixture, the mounting portion can be arranged at any position of the lamp body that is communicated with the inner cavity of the lamp body. Thus, the mounting portion is easy to design. Because the breathable film has waterproof and breathable performances, the problem of a pressure difference between the inside and outside of the lighting fixture during on and off of the lighting fixture can be effectively solved through the breathable film, thereby effectively improving waterproofness of the outdoor lighting fixture. With the press-fit design of the washer, the problem of poor reliability of a breathable film product when mounted separately can be solved, so that falling off of the breathable film can be effectively prevented. Moreover, with the design of the elastic fastener, the whole mounting process of the breathing structure is simplified, and the washer can keep a certain amount of compression at all times, so as to ensure the attaching degree of the breathable film.

Further, the washer is provided with the vent slot embodied as the cross-shaped slot to ensure that the entire breathing structure can fully breathe through the cross-shaped slot, thereby achieving better breathing effect. Furthermore, the barb-shaped clips arranged on the elastic fastener provides a stronger locking capacity to the elastic fastener, thereby further improving reliability of the entire breathing structure.

The present disclosure provides a method of manufacturing a lighting fixture. The method may include providing a lamp body comprising an inner cavity; arranging a light emitting component in the inner cavity; providing a breathing structure for the lighting fixture; arranging a mounting portion on the lamp body that is protruded from the lamp body; forming a through hole in the mounting portion where the through hole penetrates the mounting portion and is communicated with the inner cavity of the lamp body; arranging a breathable film on one end of the through hole facing towards an outside of the lamp body; arranging a washer on the breathable film that is provided with a vent slot; and fastening an elastic fastener on the mounting portion that is configured to compress the washer towards a direction of the inner cavity of the lamp body.

The method may also include providing a pressing portion in a planar shape for the elastic fastener, connecting two bending portions to two ends of the pressing portion, and connecting two retaining portions which are opposite to each other to the two bending portions; and in condition that the elastic fastener is fastened on the mounting portion, abutting the retaining portions against a peripheral wall of the mounting portion, so that the pressing portion is in close contact with a top surface of the washer.

The method may further include providing two planar-shaped lateral surfaces that are opposite and parallel to each other for the peripheral wall of the mounting portion; and in condition that the elastic fastener is fastened on the mounting portion, abutting the retaining portions against the two planar-shaped lateral surfaces of the mounting portion.

The above description is only an overview of the technical solutions of the present disclosure, and in order that the technical solutions of the present disclosure are understood more clearly, so as to be implemented according to the contents of the specification, and the above-described and other purposes, features and advantages of the present disclosure are more obvious and understandable, specific implementation modes of the present disclosure are specifically illustrated hereinafter.

Hereinafter, examples of the present disclosure will be described in detail in conjunction with the accompanying drawings, so that the above-described and other purposes, features and advantages of the present disclosure are more obvious to those skilled in the art.

In the description provided here, a lot of specific details are illustrated. However, it can be understood that the examples of the present disclosure can be practiced without these specific details. In some examples, well-known methods, structures, and technologies are not shown in detail, so as not to obscure the understanding of this description.

Finally, it is to be noted that the above various examples are only used to illustrate the technical solutions of the present disclosure and not used to limit the same. Although the present disclosure is described in detail with reference to the foregoing examples, those skilled in the art should understand that they are capable of modifying the technical solutions described in the foregoing examples, or equivalently replacing part or all of the technical features within the spirit and principle of the present disclosure, and all these modifications and replacements will not make the technical solutions depart from the protection scope of the present disclosure.

The invention claimed is:

1. A breathing structure for a lighting fixture comprising a lamp body which has an inner cavity, comprising: a mounting portion, arranged on the lamp body and protruded from the lamp body; a through hole, formed in the mounting portion, the through hole penetrating the mounting portion and being communicated with the inner cavity of the lamp body; a breathable film, arranged on one end of the through hole facing towards an outside of the lamp body; a washer, arranged on the breathable film and provided with a vent slot, wherein the washer is in direct contact with the breathable film; and an elastic fastener, fastened on the mounting portion and configured to compress the washer towards a direction of the inner cavity of the lamp body, wherein the elastic fastener comprises a pressing portion in a planar shape, a bending portion and a retaining portion, wherein the retaining portion is directly abutted against a peripheral wall of the mounting portion to be in an interference fit with the peripheral wall of the mounting portion, and the pressing portion is in close contact with a top surface of the washer with an intervening vent slot in between the pressing portion and the top surface of the washer.

2. The breathing structure as claimed in claim 1, wherein the vent slot is a cross-shaped slot.

3. The breathing structure as claimed in claim 1, wherein the elastic fastener is a U-shaped elastic fastener.

4. The breathing structure as claimed in claim 1, wherein:

the through hole is a counter bore, a bore diameter of one end, facing towards the outside of the lamp body, of the counter bore is greater than a bore diameter of the other end of the counter bore;

the breathable film is arranged on a bottom surface, of the one end with a larger bore diameter, of the counter bore; and at least part of the vent slot is exposed to a top surface of the mounting portion.

5. The breathing structure as claimed in claim 1, wherein the mounting portion comprises a cylindrical base close to the inner cavity of the lamp body, and a frustoconic portion that is gradually reduced from one end close to the inner cavity of the lamp body to the other end facing towards the outside of the lamp body.

6. The breathing structure as claimed in claim 3, wherein:

the elastic fastener comprises the pressing portion in a planar shape, two bending portions are connected to two ends of the pressing portion, and two retaining portions which are opposite to each other are connected to the two bending portions; and in condition that the elastic fastener is fastened on the mounting portion, the retaining portions are abutted against a peripheral wall of the mounting portion, so that the pressing portion is in close contact with a top surface of the washer.

7. The breathing structure as claimed in claim 6, wherein:

the peripheral wall of the mounting portion comprises two planar-shaped lateral surfaces that are opposite and parallel to each other; and in condition that the elastic fastener is fastened on the mounting portion, the retaining portions are abutted against the two planar-shaped lateral surfaces of the mounting portion.

8. The breathing structure as claimed in claim 6, wherein:

at least one of the two retaining portions is provided with a barb-shaped clip; and the barb-shaped clip obliquely extends from an inner side of the retaining portion to the pressing portion and is configured to be abutted against the peripheral wall of the mounting portion in condition that the elastic fastener is fastened on the mounting portion.

9. The breathing structure as claimed in claim 8, wherein the barb-shaped clip and the retaining portion are integrally molded.

10. The breathing structure as claimed in claim 4, wherein a bottom surface of the vent slot is not lower than the top surface of the mounting portion.

11. A lighting fixture, comprising: a lamp body comprising an inner cavity; a light emitting component, arranged in the inner cavity; and a breathing structure for the lighting fixture, wherein the breathing structure comprises: a mounting portion, arranged on the lamp body and protruded from the lamp body; a through hole, formed in the mounting portion, the through hole penetrating the mounting portion and being communicated with the inner cavity of the lamp body; a breathable film, arranged on one end of the through hole facing towards an outside of the lamp body; a washer, arranged on the breathable film and provided with a vent slot, wherein the washer is in direct contact with the breathable film; and an elastic fastener, fastened on the mounting portion and configured to compress the washer towards a direction of the inner cavity of the lamp body, wherein the elastic fastener comprises a pressing portion in a planar shape, a bending portion and a retaining portion, wherein the retaining portion is directly abutted against a peripheral wall of the mounting portion to be in an interference fit with the peripheral wall of the mounting portion, and the pressing portion is in close contact with a top surface of the washer with an intervening vent slot in between the pressing portion and the top surface of the washer.

12. The lighting fixture as claimed in claim 11, wherein the vent slot is a cross-shaped slot.

13. The lighting fixture as claimed in claim 11, wherein the elastic fastener is a U-shaped elastic fastener.

14. The lighting fixture as claimed in claim 13, wherein:

the elastic fastener comprises the pressing portion in a planar shape, two bending portions are connected to two ends of the pressing portion, and two retaining portions which are opposite to each other are connected to the two bending portions; and in condition that the elastic fastener is fastened on the mounting portion, the retaining portions are abutted against a peripheral wall of the mounting portion, so that the pressing portion is in close contact with a top surface of the washer.

15. The lighting fixture as claimed in claim 14, wherein:

the peripheral wall of the mounting portion comprises two planar-shaped lateral surfaces that are opposite and parallel to each other; and in condition that the elastic fastener is fastened on the mounting portion, the retaining portions are abutted against the two planar-shaped lateral surfaces of the mounting portion.

16. The lighting fixture as claimed in claim 14, wherein:

at least one of the two retaining portions is provided with a barb-shaped clip; and the barb-shaped clip obliquely extends from an inner side of the retaining portion to the pressing portion and is configured to be abutted against the peripheral wall of the mounting portion in condition that the elastic fastener is fastened on the mounting portion.

17. The lighting fixture as claimed in claim 16, wherein the barb-shaped clip and the retaining portion are integrally molded.

18. A method of manufacturing a lighting fixture, comprising: providing a lamp body comprising an inner cavity; arranging a light emitting component in the inner cavity; providing a breathing structure for the lighting fixture; arranging a mounting portion on the lamp body that is protruded from the lamp body; forming a through hole in the mounting portion wherein the through hole penetrates the mounting portion and is communicated with the inner cavity of the lamp body; arranging a breathable film on one end of the through hole facing towards an outside of the lamp body; arranging a washer on the breathable film that is provided with a vent slot, wherein the washer is in direct contact with the breathable film; and fastening an elastic fastener on the mounting portion that is configured to compress the washer towards a direction of the inner cavity of the lamp body, wherein the elastic fastener comprises a pressing portion in a planar shape, a bending portion and a retaining portion, wherein the retaining portion is directly abutted against a peripheral wall of the mounting portion to be in an interference fit with the peripheral wall of the mounting portion, and the pressing portion is in close contact with a top surface of the washer with an intervening vent slot in between the pressing portion and the top surface of the washer.

19. The method of claim 18, further comprising:

providing the pressing portion in a planar shape for the elastic fastener, connecting two bending portions to two ends of the pressing portion, and connecting two retaining portions which are opposite to each other to the two bending portions; and in condition that the elastic fastener is fastened on the mounting portion, abutting the retaining portions against a peripheral wall of the mounting portion, so that the pressing portion is in close contact with a top surface of the washer.

20. The method of claim 18, further comprising:

providing two planar-shaped lateral surfaces that are opposite and parallel to each other for the peripheral wall of the mounting portion; and in condition that the elastic fastener is fastened on the mounting portion, abutting the retaining portions against the two planar-shaped lateral surfaces of the mounting portion.

* * * * *